United States Patent [19]

Bessette et al.

[11] Patent Number: 5,048,288

[45] Date of Patent: Sep. 17, 1991

[54] COMBINED TURBINE STATOR COOLING AND TURBINE TIP CLEARANCE CONTROL

[75] Inventors: Alan D. Bessette, Palm Beach Gardens; Daniel O. Davies, West Palm Beach; John L. Shade, Jupiter, all of Fla.

[73] Assignee: United Technologies Corporation, Hartford, Conn.

[21] Appl. No.: 644,461

[22] Filed: Nov. 13, 1990

Related U.S. Application Data

[63] Continuation of Ser. No. 286,838, Dec. 20, 1988, abandoned.

[51] Int. Cl.[5] ..... F02C 7/18

[52] U.S. Cl. ..... 60/226.1; 60/39.75; 415/116

[58] Field of Search ..... 60/39.75, 39.07, 226.1, 60/262; 415/115, 116, 117, 136, 137, 138, 139, 175, 180

[56] References Cited

U.S. PATENT DOCUMENTS

| | | | |
|---|---|---|---|
| 3,742,705 | 7/1973 | Sifford | 415/117 |
| 3,975,901 | 8/1976 | Hallinger et al. | 415/115 |
| 4,069,662 | 1/1978 | Redinger, Jr. et al. | 415/116 |
| 4,304,093 | 12/1981 | Schulze | 60/39.07 |
| 4,317,646 | 3/1982 | Steel et al. | 415/116 |
| 4,487,016 | 12/1984 | Schwarz et al. | 60/39.75 |
| 4,596,116 | 6/1986 | Mandet et al. | 60/39.07 |
| 4,683,716 | 8/1987 | Wright et al. | 60/226.1 |

*Primary Examiner*—Louis J. Casaregola
*Attorney, Agent, or Firm*—Norman Friedland

[57] ABSTRACT

The outer air seal of a gas turbine engine is continuously cooled by compressor discharge air (primary) and a by-pass line (secondary) which can be throttled or shut off, augments cooling during high power conditions and is throttled or shut off at reduced power conditions, allowing the casing scrubbed by fan discharged air to shrink and reduce the clearance of the tips of the turbine blades. The air from the continuous flow (primary) line is routed to the outer air seals in a manner to avoid scrubbing the engine case.

7 Claims, 2 Drawing Sheets

COMBINED TURBINE STATOR COOLING AND TURBINE TIP CLEARANCE CONTROL

The invention was made under a U.S. Government contract and the Government has rights herein.

DESCRIPTION

This application is a continuation of application Ser. No. 286,838, filed Dec. 20, 1988, now abandoned.

TECHNICAL FIELD

This invention relates to gas turbine engines and particularly to a system that combines cooling of the outer air seals of the turbine and turbine blade tip clearance control.

BACKGROUND OF THE INVENTION

It is well known that aircraft engines operate at substantially high temperatures and a portion of the air ingested by the engine is utilized for cooling, among other components, the stator structure in the hot sections of the engine. Typically, compressor bleed air is diverted to be routed to the outer air seals that surround the tips of the turbine blades and then discharged into the gas path of the engine or elsewhere. It is conventional to design the engine with the requisite amount of air to maintain the components within their structural integrity for the most severe conditions encountered. This establishes the amount of air bled from the compressor over the entire flight envelope. Obviously, at certain engine operating modes, more air than is actually necessary will be bled from the compressor hence incurring a penalty in engine performance.

It is also desirable to maintain the gap between the tips of the turbine blades, particularly the axial flow type, and its outer air seal as small as possible throughout the flight envelope. As will be appreciated, since the material of the stator components and the turbine rotor is different, and since the inertia effect has an influence on the growth of the rotor, the stator components, i.e., the engine case, outer air seal and support mechanism, grow at a different rate than the growth of the rotor. When the power is relaxed, the casing will tend to contract to a smaller diameter, as will the rotor, due to lower temperature and inertia leaving a gap between the tips of the blades and outer air seal. It is apparent that the transient conditions will establish the necessary gap for the steady state condition. This gap, however, is a leakage path for the engine's working medium being directed into the turbine airfoils for doing useful work. The amount of leakage of this working medium likewise results in a penalty to the engine's performance. There are other flight conditions that present similar problems as just described and can be more aggravated. Thus, for example, bodies, where the power lever is chopped (decelerate engine) and immediately re-burst (accelerate engine), can be a significant challenge to the engine designer because the components, i.e. rotor and stator, are already in a heated condition prior to a transient.

The industry has seen a number of different schemes for meeting this challenge. For example, U.S. Pat. No. 4,069,662 granted to I. H. Redinger, Jr. et al on Jan. 24, 1978 and assigned to United Technologies Corporation, the same assignee as this patent application, is a system that impinges cool air on the engine case at a selected engine operating condition in order to contract the case, and force the outer air seals which are tied to the case toward the tips of the blade to reduce the gap. However, systems that may be satisfactory for engines used to power commercial aircraft may not necessarily be satisfactory for engines used in military applications.

Thus, the particular application and engine mandate different techniques to meet this challenge not only to arrive at systems that will reduce the gap, but also to arrive at solutions that seek the least amount of leakage possible, if any.

We have found that we can attain an improvement in engine performance of a fan-jet engine by combining the control of the cooling air for the turbine's outer air seal and control of turbine blade tip clearance. This method contemplates throttling the cooling air to the outer air seal at preselected part power conditions of engine operations and allowing the air from the fan to scrub the outer engine case to cool and shrink it to force the outer air seals tied to the engine case to reduce the gap between it and the tips of the turbine blades. In this configuration, two supply routes are utilized, where one continuously supplies cooling air from the compressor, to the outer air seals and another throttles the air from that same source at predetermined conditions of engine operation. The continuous supplied air is routed into the outer air seal in such a manner as to avoid scrubbing the inner wall of the turbine case. The throttled cooling air is routed to intentionally scrub the inner walls of the turbine case. The reason being is that when the throttled cooling air is turned off, the much cooler air discharging from the fan that scrubs the outer wall of the engine case enhances the cooling effect and attains a tighter blade tip clearance.

DISCLOSURE OF INVENTION

An object of this invention is to provide for fan-jet engine powering aircraft means for improving engine performance by optimizing air cooling of the turbine's outer air seal and simultaneously provide turbine blade clearance control.

A feature of this invention is to provide a dual path for flowing cooling air to the outer air seal and throttling the air in one of the paths. The air in the path continuously feeding cooling air to the outer air seal is routed to avoid scrubbing the inner wall of the engine case.

Another feature of this invention is to allow the fan discharge air only (by removing compressor discharge air scrubbing) to scrub the outer diameter of the engine case so as to contract the outer air seals tied to that case to obtain improved tightness of the blade tip clearance.

A still further feature of this invention is to obtain improved gas turbine engine performances by reducing the turbine blade tip clearance and by efficient use of the cooling air for the outer air seals obtained by throttling a portion of the cooling air resulting in savings of cooling air during part power engine operations.

The foregoing and other features and advantages of the present invention will become more apparent from the following description and accompanying drawing.

BEST MODE FOR CARRYING OUT THE INVENTION

Figure 1:
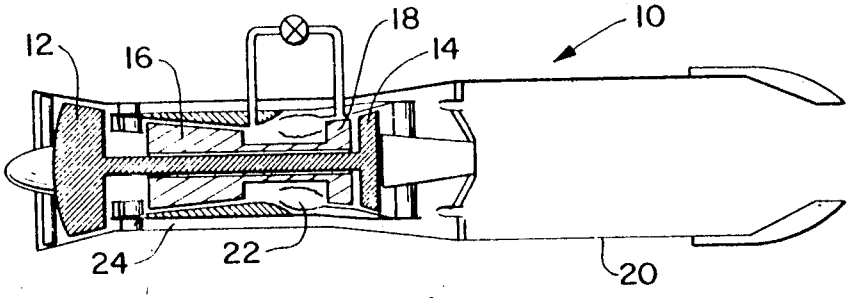
FIG. 1 is a schematic of a twin spool fan jet engine with augmentor.
Figure 2:
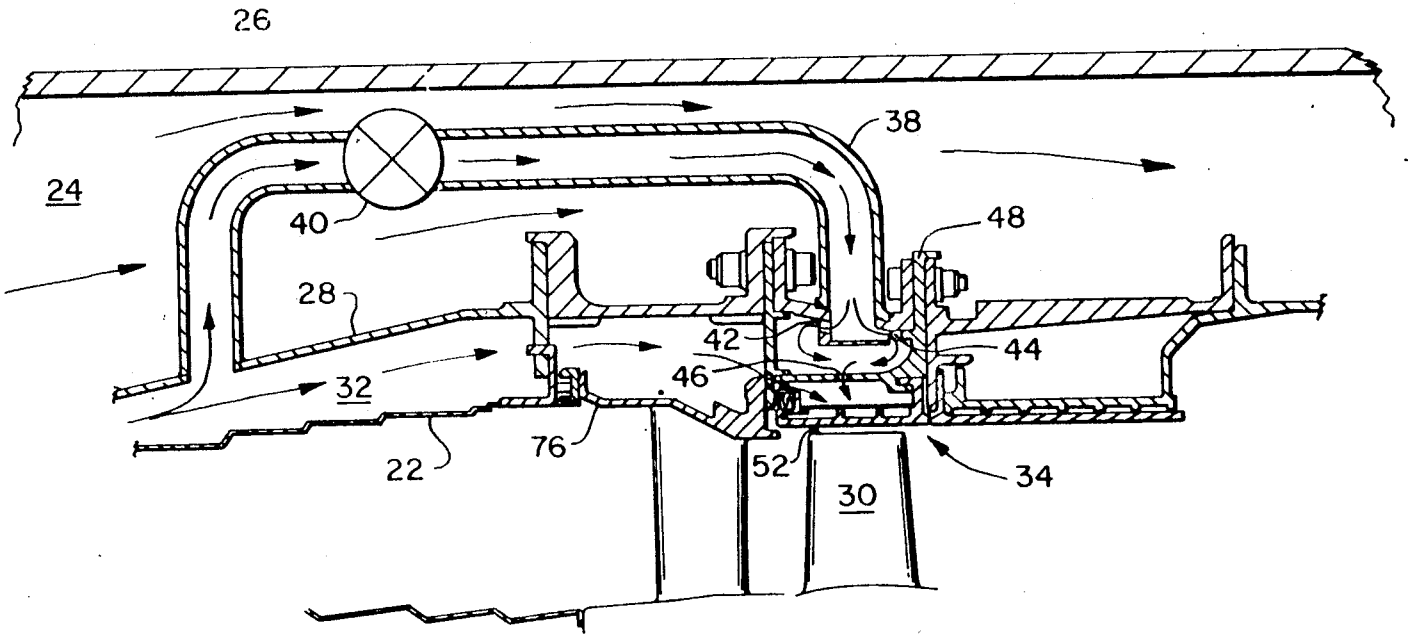
FIG. 2 is a partial enlarged view in schematic and section showing the details of the invention.

The invention can be best understood by referring to FIGS. 1 and 2 showing schematically a fan jet engine having twin spools and an augmentor of the type designated the F-100 series manufactured by Pratt & Whitney, a division of United Technologies Corporation, the assignee of this patent application. As noted, the engine generally illustrated by reference numeral 10 comprises a low pressure spool consisting of a fan/compressor section 12 driven by the low pressure turbine 14, a high pressure compressor section 16 driven by a high pressure turbine 18 and an augmentor 20. Air ingested into the inlet of the engine is first compressed by multi stages of compressors in the low pressure compressor section 12 and further compressed by multi stages of compressors in the high pressure compressor section 16. As noted above, a portion of the air is utilized for the cooling of engine component and this air is routed outside of the annular burner 22 to be utilized as desired and a portion thereof to cool the outer air seals as will be described hereinbelow. The majority of the air, of course, is delivered to the annular burner 22, where it is used in the combustion process of fuel. The products of combustion, or the engine working medium is utilized to power turbines 18 and 14 for driving the fan/low pressure compressor 12 and high pressure compressor 16. The amount of energy remaining in the engine's working medium that hasn't been extracted for powering the turbines is utilized for imparting a thrust moment to propel the aircraft.

The fan/low pressure compressor section comprises an integral fan that extends radially for imparting additional thrust to the engine. As shown, the air discharging from the fan portion of the fan/low pressure compressor section 12 is directed through the outer annular passage 24 where it is routed to the augmentor 20.

In augmentor operation additional fuel is added to the augmentor to combust with the fan discharge air and the spent engine working medium to augment the thrust.

The operation and details of a gas turbine engine of the type described above is available in literature describing the F100 engine, supra, which is incorporated herein by reference. Suffice it to say, in the embodiment incorporating this invention, the engine casing adjacent the high pressure turbine section is continuously scrubbed by the cool air discharging from the fan.

As can be seen in FIG. 2, the fan annular passageway 24 defined by the engine's cowling 26 and the engine case 28 flows fan discharge air over the case adjacent the first turbine blades 30 (only one being shown) of the high pressure turbine rotor 18 (since this is a single stage turbine, the terms section and rotor are used synonymously). Obviously, the cooler fan discharge air has the tendency of limiting the expansion of the case 28. It will be appreciated that the engine case 28 is in fact comprised of a plurality of cases that are suitably attached at complementary flanges.

As will be apparent from the foregoing, the portion of cooling air discharging from the compressor section 16 flows through the annular passage 32 around the outer periphery of the annular combustor 22 to the outer air seal generally illustrated by reference numeral 34 where it serves to cool the stator components. This type of cooling is customary and is typical of this type of installation. Heretofore, this type of system is designed such that the amount of cooling air specified for the cooling aspects of these components of the engine is dictated by the amount of cooling that is necessary to maintain the structural integrity of these components when encountering the most hostile environment. Hence, the amount of air utilized for this cooling purpose is a compromise between the amount of cooling that is necessary for the worse case scenario and the amount of penalty in engine performance associated with the air used for this purpose; it being noted that air used for cooling purposes is deemed a penalty in engine performance.

Obviously, since the flow is continuous and sized for the worse case scenario, excess cooling air will be flowed even though it isn't needed. Thus, this excess cooling air is additional penalty to the engine's performance.

According to this invention, an additional cooling passage having the capability of being able to throttle or shut off the flow of cooling air is connected to the same cooling air source (compressor discharge air). As noted conduit 38 having disposed therein a controllable valve 40 interconnects the annular passageway 32 and outer air seal through openings 42 and 44 formed adjacent conduit 38 and opening 46 formed in the outer air seal support 48.

Figure 3:
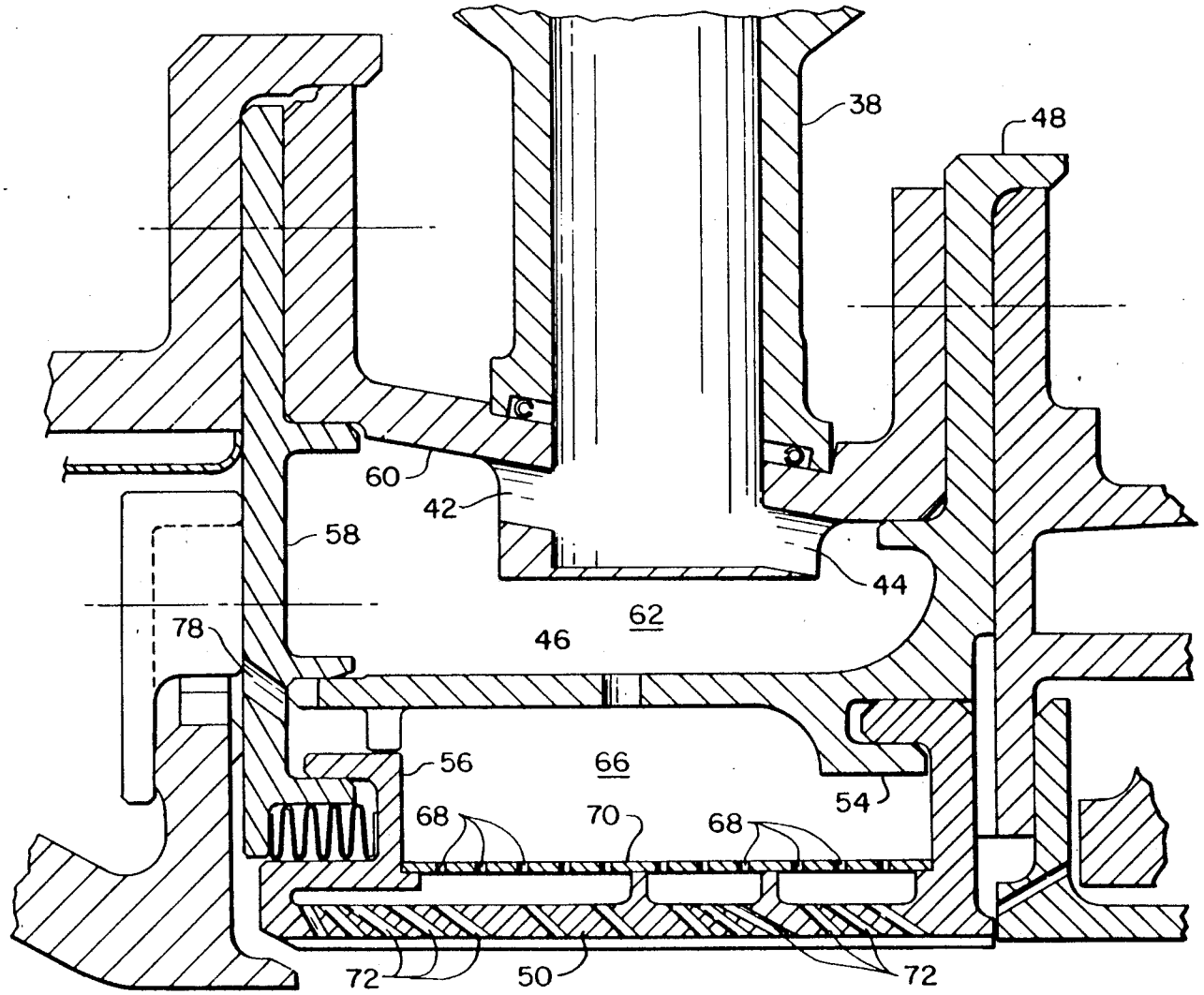
FIG. 3 is an enlarged view of the stator structure adjacent the turbine rotor of the engine further illustrating the details of the invention.

The stator structure can be better seen in FIG. 3 showing the outer air seal 34 and its supporting structure. The outer air seal comprises a plurality of arcuate segments 50, circumferentially disposed about the tips 52 of the blades 30. Each segment is attached to hook 54 formed in the inner diameter of support 48 and the hook 56 formed integrally with segment 50 supported to the ring 58. Conduit 38 is suitably attached to turbine casing 60 (one of the engine case modules) and directs cooling air through apertures 42 and 44, annular cavity 62, opening 46 formed in member 48, annular cavity 66 and a plurality of impingement holes 68 formed in baffle or impingement ring 70 to impinge on the rear face of segment 50. The spent air is then discharged into the gas path (engine working medium) through a plurality of apertures 72 formed in segment 50.

Cooling air in annular passageway 32 continuously cools the outer air seal 34 by flowing cooling air along the engine's inner casing members 76 in such a way as to avoid scrubbing the inner walls 60 of the turbine case. This air eventually flows to the outer air seal 34 through a plurality of holes 78 (one being shown) formed in ring 58 over hook 56 into cavity 66 and then through the impingement holes 68 in impingement ring 70.

It is apparent from the foregoing that the valve 40 controls the flow of additional air to the outer air seal 34 to assure sufficient cooling during the most hostile scenario. It is, therefore, likewise apparent that this additional cooling air can be throttled or turned off to meet the cooling demands of other conditions of the engine's operating envelope. It is apparent from the foregoing that throttling the air results in an engine performance benefit since it reduces cooling air flow. For example, during cruise, which is at a reduced power condition, it may be desirable to shut off the flow of the additional air in conduit 38. Hence, the only cooling will be from the cooling air being supplied through holes 78 (primary cooling air). Since the fan discharge air is cooler than the compressor discharge air, the engine case which is being scrubbed by this air will contract to reduce the gap between the tip 52 of the turbine blade and the outer air seal segments 50. Further, since the flow of air being delivered through the conduit 38 (secondary cooling air), which is at an elevated temperature, is shut off or reduced and doesn't scrub the engine case that air or absence of air will not affect or minimize the effect of the cooling aspects of the fan discharge air.

It is contemplated within the scope of this invention that control of valve 40 can be manipulated manually or automatically by a system similar to the one disclosed in U.S. Pat. No. 4,069,662, supra.

Although this invention has been shown and described with respect to detailed embodiments thereof, it will be understood by those skilled in the art that various changes in form and detail thereof may be made without departing from the spirit and scope of the claimed invention.

We claim:

1. For an aircraft fan jet engine having an engine case, a fan duct surrounding said engine casing and flowing fan discharge air therethrough, a turbine with a plurality of blades each having a tip portion rotatably supported in said engine casing, an outer air seal surrounding said blades and defining a gap between said outer air seal and said tip, first means for cooling said outer air seal by continuously directing a portion of cool engine air obtained from a source to said outer air seal, and second means by-passing said first means leading another portion of said cool engine air also obtained from said source to said outer air seal and means for throttling or shutting off said other portion of said cool engine air in said second means, whereby said second means for by-passing is rendered partially or totally inoperative permitting said engine casing to influence the growth or said outer air seal.

2. For an aircraft fan-jet engine as in claim 1, wherein said engine includes a compressor, and said cool engine air is the compressor discharge air.

3. For an aircraft fan-jet engine as claimed in claim 2, wherein the fan includes a fan discharge conduit, said engine casing defining a portion of the conduit, whereby the discharge air from said fan scrubs said engine casing to cool said engine casing causing it to shrink and tend to close said gap.

4. In combination, in a fan-jet engine, a turbine rotor having a plurality of radially extending blades, an outer air seal shrouding the tips of said blades and defining therewith a gap allowing said outer air seal and said blade to expand and contract without contact, a supply of cooling air, means interconnecting said supply and said outer air seals for leading a portion of said cooling air onto said outer air seals, by-pass means interconnecting said outer air seal and said supply for leading another portion of cooling air to said outer air seals while by-passing said first mentioned means, valve means disposed in said by-pass means, and means for controlling said valve means for adjusting the flow of said cooling air in said by-pass means.

5. In combination as claimed in claim 4, including an outer case surrounding and supporting said turbine rotor, wherein said fan-jet engine includes a discharge conduit for flowing fan discharge air over said outer case, means for supporting said outer air seals by said outer case, and the temperature of said fan discharge air affecting the thermal growth of said outer case, whereby said outer case tends to shrink a greater amount when said valve means is adjusted to lower or shut off the flow in said by-pass means.

6. In combination as claimed in claim 5, wherein said outer air seals include a plurality of apertures for leading said portions of cooling air through said outer air seals into said turbine rotor.

7. In combination as in claim 4 including a compressor being driven by said turbine rotor for pressurizing air ingested by said compressor, and said supply being a portion of said pressurized air.

* * * * *